US009112305B2

(12) United States Patent
Sato et al.

(10) Patent No.: US 9,112,305 B2
(45) Date of Patent: Aug. 18, 2015

(54) TERMINAL ALIGNING CONNECTOR UNIT

(75) Inventors: Akira Sato, Makinohara (JP); Kazuhide Takahashi, Makinohara (JP); Kenji Takahashi, Makinohara (JP); Tomonari Okamoto, Anjo (JP); Teruo Kato, Okazaki (JP)

(73) Assignees: Yazaki Corporation, Tokyo (JP); AISIN AW CO., LTD., Aichi (JP)

( * ) Notice: Subject to any disclaimer, the term of this patent is extended or adjusted under 35 U.S.C. 154(b) by 17 days.

(21) Appl. No.: 14/123,254

(22) PCT Filed: Jun. 1, 2012

(86) PCT No.: PCT/JP2012/064330

§ 371 (c)(1),
(2), (4) Date: Jan. 24, 2014

(87) PCT Pub. No.: WO2012/165635

PCT Pub. Date: Dec. 6, 2012

(65) Prior Publication Data

US 2014/0134868 A1 May 15, 2014

(30) Foreign Application Priority Data

Jun. 3, 2011 (JP) ..... 2011-124772

(51) Int. Cl.

| | |
|---|---|
| ***H01R 4/50*** | (2006.01) |
| ***H01R 13/627*** | (2006.01) |
| ***H01R 13/52*** | (2006.01) |
| *H01R 13/42* | (2006.01) |

(52) U.S. Cl.

CPC ..... *H01R 13/627* (2013.01); *H01R 13/5219* (2013.01); *H01R 13/42* (2013.01)

(58) Field of Classification Search

CPC ..... H01R 13/6275; H01R 13/6272; H01R 13/641

USPC ..... 439/345, 350, 352, 353, 357, 489

See application file for complete search history.

(56) References Cited

U.S. PATENT DOCUMENTS

| | | | | |
|---|---|---|---|---|
| 6,109,956 | A * | 8/2000 | Kawase et al. | 439/489 |
| 6,126,480 | A * | 10/2000 | Kawase et al. | 439/489 |
| 6,196,687 | B1 | 3/2001 | Smith | |

(Continued)

FOREIGN PATENT DOCUMENTS

| | | |
|---|---|---|
| CN | 1207596 A | 2/1999 |
| JP | 9-45417 A | 2/1997 |

(Continued)

OTHER PUBLICATIONS

International Search Report (PCT/ISA/210), dated Aug. 21, 2012, issued by the International Searching Authority in counterpart International Patent Application No. PCT/JP2012/064330.

(Continued)

*Primary Examiner* — Thanh Tam Le
(74) *Attorney, Agent, or Firm* — Sughrue Mion, PLLC

(57) ABSTRACT

When a male terminal connector (10) and a female terminal connector (50) are engaged with each other, projecting inclined faces (20*a*) and partition wall inclined faces (59) which are opposed to each other are brought into contact or made opposed to each other, and, fitting projections (61) insert into fitting recesses (21) in such a manner that the fitting projections (61) and the fitting recesses (21) are held with gaps between them.

3 Claims, 6 Drawing Sheets

(56) References Cited

U.S. PATENT DOCUMENTS

| | | | | |
|---|---|---|---|---|
| 6,971,906 | B2 * | 12/2005 | Yamaoka | 439/489 |
| 7,033,201 | B2 * | 4/2006 | Ichida et al. | 439/352 |
| 7,104,831 | B2 * | 9/2006 | Fukatsu et al. | 439/385 |
| 7,553,186 | B2 * | 6/2009 | Morikawa et al. | 439/587 |
| 7,588,454 | B2 * | 9/2009 | Nakata et al. | 439/357 |
| 7,736,197 | B2 * | 6/2010 | Takeda | 439/680 |
| 7,753,613 | B2 * | 7/2010 | Tsuji | 403/326 |
| 7,806,715 | B2 * | 10/2010 | Zheng | 439/352 |
| 8,449,313 | B2 * | 5/2013 | Suzuki et al. | 439/357 |
| 2003/0008555 | A1 | 1/2003 | Obata | |
| 2003/0077947 | A1 | 4/2003 | Sugimori | |

FOREIGN PATENT DOCUMENTS

| | | | |
|---|---|---|---|
| JP | 10-302873 | A | 11/1998 |
| JP | 2003123894 | A | 4/2003 |
| JP | 2005-56669 | A | 3/2005 |
| JP | 2010-27507 | A | 2/2010 |

OTHER PUBLICATIONS

Written Opinion (PCT/ISA/237), dated Aug. 21, 2012, issued by the International Searching Authority in counterpart International Patent Application No. PCT/JP2012/064330.

International Preliminary Report on Patentability dated Dec. 19, 2013 issued in International Application No. PCT/JP2012/064330 (PCT/IB/338/373).

Written Opinion dated Dec. 19, 2013 issued in International Application No. PCT/JP2012/064330 (PCT/ISA/237).

Office Action dated Mar. 20, 2015 issued by the Korean Intellectual Property Office in counterpart Korean Patent Application No. 10-2013-7032054.

Office Action dated Feb. 3, 2015, issued by the Japanese Intellectual Property Office in counterpart Japanese Application No. 2011-124772.

Communication from the State Intellectual Property Office of P.R. China dated May 6, 2015 in a counterpart Chinese application No. 201280026956.8.

* cited by examiner

TERMINAL ALIGNING CONNECTOR UNIT

TECHNICAL FIELD

The present invention relates to a connector unit which has a male terminal connector provided with a plurality of male terminals, and a female terminal connector provided with a plurality of female terminals to be connected to respective of a plurality of the male terminals.

BACKGROUND ART

Conventionally, there has been a connector unit which has a male terminal connector provided with a plurality of male terminals, and a female terminal connector provided with a plurality of female terminals to be connected to respective of a plurality of the male terminals. In such a connector unit, it is important to prevent intrusion of foreign matters into connection parts between the male terminals and the female terminals, for the purpose of reducing causes for a short circuit. A connector unit in which the connection parts between the male and female terminals can be individually cut off has been proposed in Patent Document 1.

PRIOR ART DOCUMENT

Patent Document

Patent Document 1: JP-A-2010-27507

SUMMARY OF THE INVENTION

Problems to be solved by the Invention

In the connector unit disclosed in Patent Document 1, the male and female terminals are respectively connected by engagement of housings. A terminal housing of the female connector is provided with a cut-off projection which is projected from a front end face of the terminal housing, and the cut-off projection is adapted to be butted against a rear wall of a terminal housing of the male connector, when the housings are engaged with each other.

By the way, it is important to secure a creepage distance between the adjacent terminals. However, it has become difficult to secure the creepage distance between the adjacent terminals, because small pitches are prevailing due to tendency of multi-polarity of the terminals.

For example, as shown in FIG. 10, in the connector unit disclosed in Patent Document 1, the creepage distance between the adjacent male terminals 110 is a distance along inclined faces 120 and a bottom face 130. As a pitch of the male terminals 110 becomes smaller, it becomes difficult to secure a long creepage distance between the male terminals 110. Consequently, there has been such a problem that insulating performance is deteriorated.

This invention has been made in view of the above described problem, and it is an object of the invention to provide a connector unit in which insulating performance can be enhanced, while restraining occurrence of a short circuit, even though a pitch between terminals becomes smaller.

Means for Solving the Problems

In order to solve the above described problem and to attain the object, a connector unit according to the invention comprising a male terminal connector which includes a plurality of male terminals, and a male terminal connector body having a front wall where a plurality of the male terminals projected from an inner face thereof are arranged in parallel, and projected holding parts which are projected from the inner face of the front wall along side faces of the respective male terminals, and a female terminal connector which includes a plurality of female terminals, and a female terminal connector body having partition walls for forming containing rooms in which a plurality of the female terminals are respectively contained, and a front end part in which openings for enabling the male terminals to be inserted into the containing rooms are formed, the male terminal connector and the female terminal connector being engaged with each other in a state that the front end part is directed to the inner face of the front wall, characterized in that in the male terminal connector, the projected holding parts have projecting inclined faces which are formed on respective both sides in a lateral direction of the male terminals, and inclined so that their heights projecting from the inner face of the front wall become smaller as being separate away from the male terminals, and fitting recesses are formed between a pair of the projected holding parts which are positioned between the adjacent two male terminals, and in the female terminal connector, the partition walls are provided with partition wall inclined faces which are inclined substantially in parallel with the projecting inclined faces, when the male terminal connector and the female terminal connector are engaged with each other, and fitting projections which are projected toward the front end part and adapted to insert into the fitting recesses, wherein the projecting inclined faces and the partition wall inclined faces are brought into contact with each other, or made opposed to each other, when the male terminal connector and the female terminal connector are engaged with each other, and at the same time, the fitting projections insert into the fitting recesses so that the fitting projections and the fitting recesses are held leaving a gap between them.

Moreover, the connector unit according to the invention is, in the above described invention, characterized in that the male terminal connector further includes male terminal connector side extended faces which are respectively formed on the projected holding parts so as to extend from the projecting inclined faces in an arranging direction of a plurality of the male terminals, and the female terminal connector further includes female terminal connector side extended faces which are formed on the partition walls so as to extend from the partition wall inclined faces in an arranging direction of a plurality of the female terminals, wherein the male terminal connector side extended faces and the female terminal connector side extended faces are brought into contact or made opposed to each other, when the male terminal connector and the female terminal connector are engaged with each other.

Further, the connector unit according to the invention is, in the above described invention, characterized in that each of the fitting projections has a rectangular parallelepiped shape.

Advantageous Effects of the Invention

In the connector unit according to the invention, because the creepage distance of the male terminal is a distance along the fitting recess and the projecting inclined faces, it is possible to secure the longer creepage distance by a distance along the inner side faces of the fitting recess. Additionally, because a mating part between the front end part of the female terminal connector and the front wall of the male terminal connector becomes complicated in shape, it becomes difficult for foreign matters to insert into connection parts between the male terminals and the female terminals from the exterior. As the results, a short circuit due to the foreign matters can be prevented, and therefore, it is possible to enhance insulating performance, while restraining occurrence of the short circuit due to the foreign matters.

Moreover, in the connector unit according to the invention, the male terminal connector has the male terminal connector side extended faces which are further extended from ends of the projecting inclined faces at a front wall inner face side and provided in the arranging direction of a plurality of the male terminals. Moreover, the female terminal connector has the female terminal connector side extended faces which are further extended from partition wall front end side ends of the partition wall inclined faces. Accordingly, when the male terminal connector and the female terminal connector are engaged with each other, the male terminal connector side extended faces and the female terminal connector side extended faces are brought into contact with each other or made opposed to each other. Therefore, the part which has been formed only by the projecting inclined faces is formed by including the projecting inclined faces and the female terminal connector side extended faces, and hence, the creepage distance can be made longer. As the results, it is possible to further enhance the insulating performance. Additionally, because the mating part between the front end part of the female terminal connector and the front wall of the male terminal connector becomes more complicated in shape, it becomes more difficult for foreign matters to insert into the connection parts between the male terminals and the female terminals.

Further, in the connector unit according to the invention, the fitting recess is formed in a concave shape corresponding to the fitting projection having a rectangular parallelepiped shape, and therefore, it is possible to reduce a depth of the fitting recess and a width of its bottom face, by utilizing the creepage distance which is increased by the projecting inclined faces and the male terminal connector side extended faces. Accordingly, it is possible to reduce a height of a protruded portion of a mold piece having a rectangular parallelepiped shape to be used for insert molding of the fitting recess, and at the same time, to increase a width thereof. As the results, durability of the mold piece to be used for the insert molding can be enhanced.

MODE FOR CARRYING OUT THE INVENTION

Figure 1:
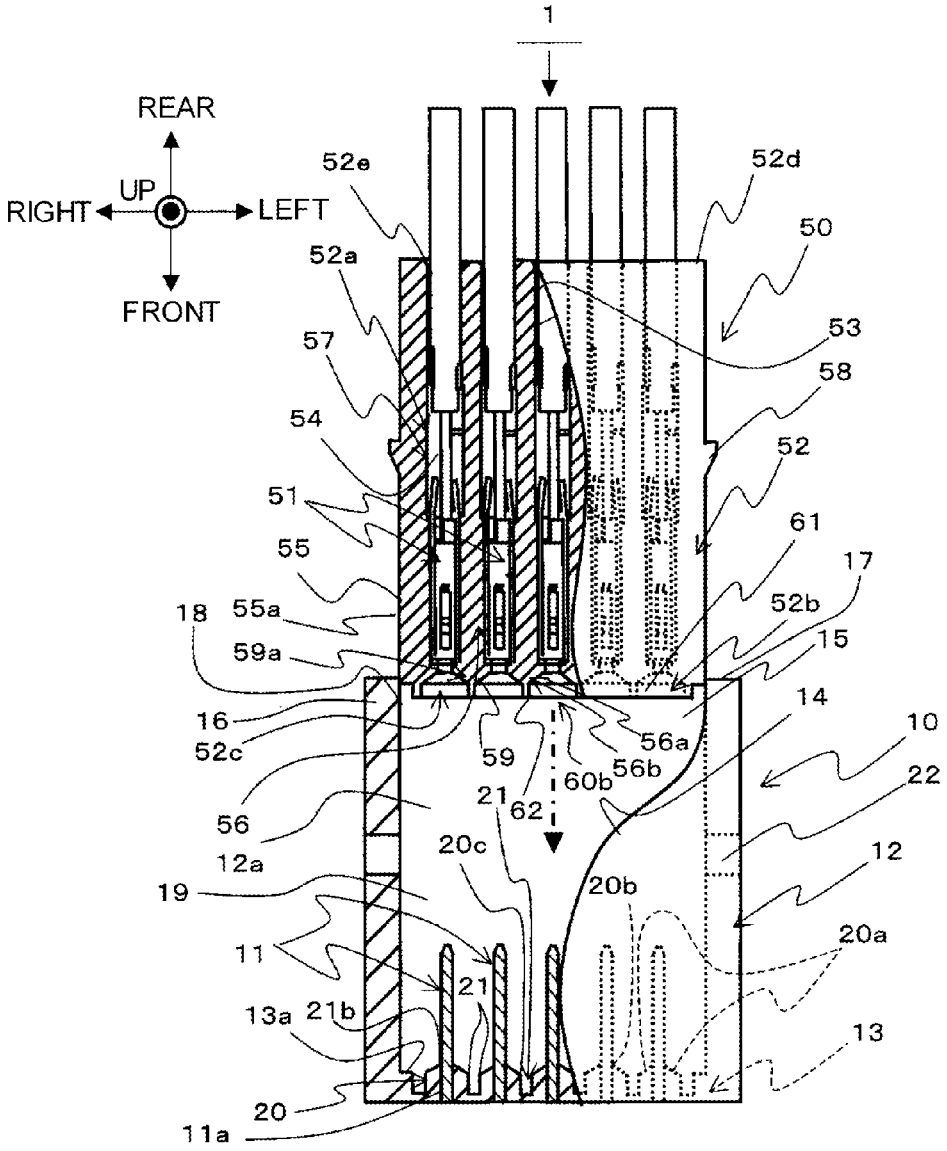
FIG. 1 is a side view, partly shown in section, of a connector unit according to Embodiment 1 of the invention, prior to engagement.

Now, referring to the drawings, preferred embodiments of the connector unit according to the invention will be described in detail.

(Embodiment 1)

Figure 2:
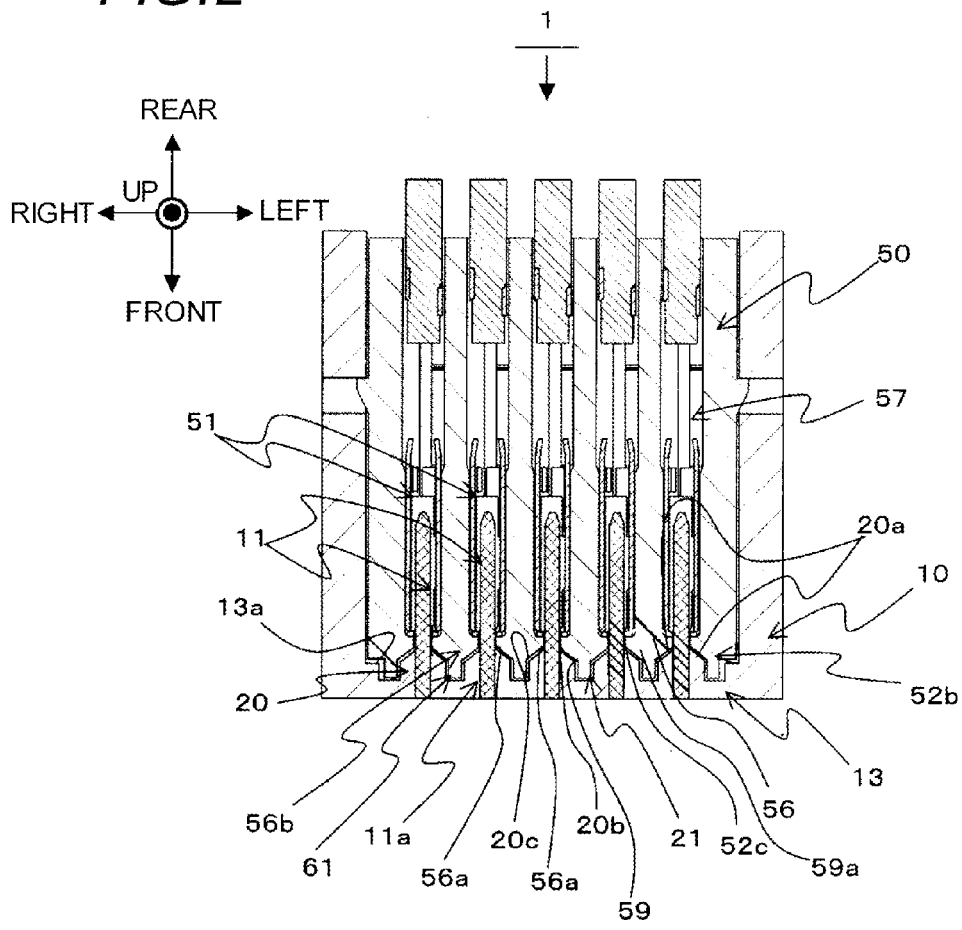
FIG. 2 is a sectional view of the connector unit as shown in FIG. 1, after the engagement.
Figure 3:
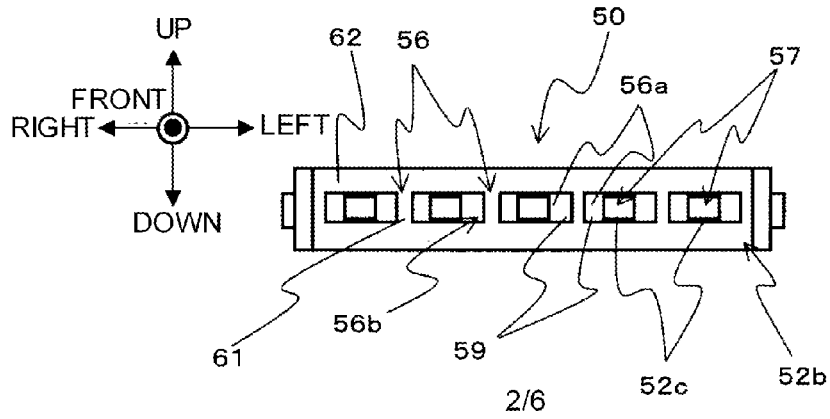
FIG. 3 is a view of a female connector as shown in FIG. 1, as seen from the front side.
Figure 4:
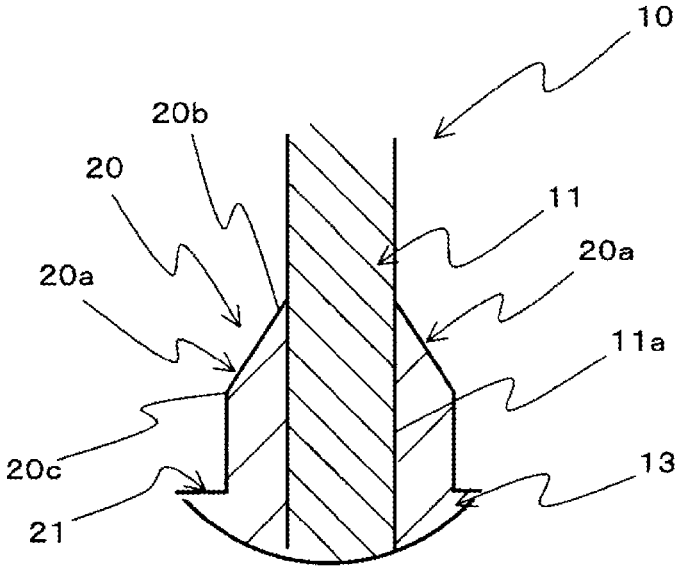
FIG. 4 is an enlarged view of a region surrounding a male terminal as shown in FIG. 2.
Figure 5:
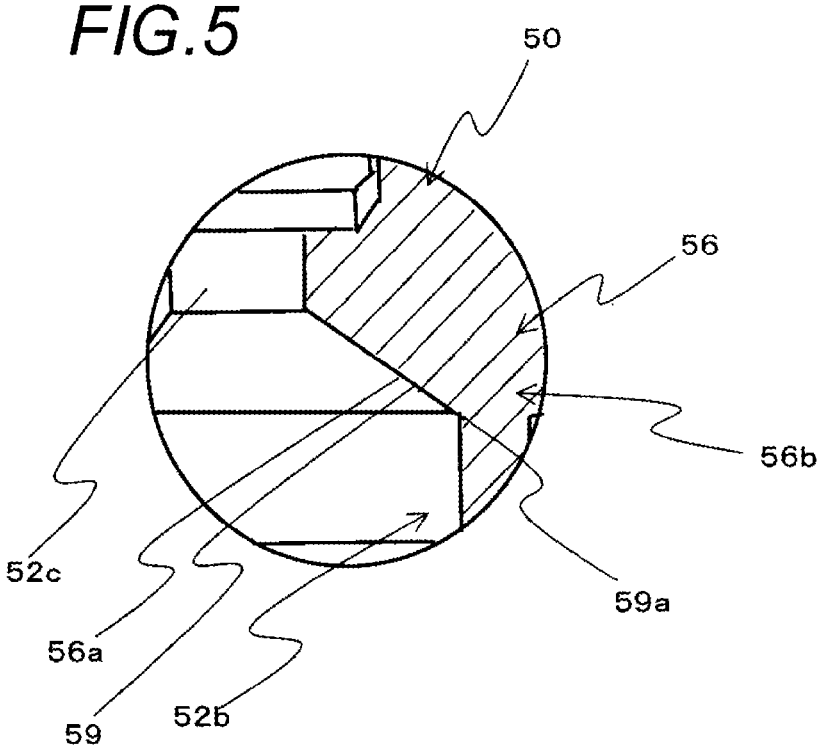
FIG. 5 is an enlarged view of a region surrounding a front end part of a partition wall as shown in FIG. 2.

FIG. 1 is a side view, partly shown in section, of a connector unit 1 according to Embodiment 1 of the invention, prior to engagement. FIG. 2 is a sectional view of the connector unit 1 as shown in FIG. 1, after the engagement. FIG. 3 is a view of a female terminal connector 50 as shown in FIG. 1, as seen from the front side. FIG. 4 is an enlarged view of a region surrounding a male terminal 11 as shown in FIG. 2. FIG. 5 is an enlarged view of a region surrounding a front end part 56*b* of a partition wall 56 as shown in FIG. 2.

It is to be noted that arrow marks which are perpendicular to one another in the drawings represent front and rear, right and left, and up and down directions. Specifically, the direction in which the female terminal connector is engaged with a male terminal connector 10 is referred to as the front, and the opposite direction is referred to as the rear. The direction in which the male terminals 11 and female terminals 51 are arranged in parallel is referred to as the right and left. The directions perpendicular to these front and rear, right and left faces are referred to as the up and down.

The connector unit 1 according to Embodiment 1 of the invention includes the male terminal connector 10 and the female terminal connector 50.

To begin with, the male terminal connector 10 will be described.

The male terminal connector 10 is the connector which is integrally provided with the five male terminals 11 by insert molding. When the male terminal connector 10 is engaged with the female terminal connector 50, a plurality of female terminals 51 which are contained in the female terminal connector 50 are respectively connected to the male terminals 11. The male terminal connector 10 is provided with a plurality of the male terminals 11 and a male terminal connector body 12.

The male terminal connector body 12 includes a front wall 13 in a rectangular shape, an upper wall 14 which is uprightly provided along edges of the front wall 13, a lower wall 15, and a pair of side walls 16, and an opening 18 is formed in its rear end part 17. An internal containing space 12*a* is defined by combination of these front wall 13, upper wall 14, lower wall 15, and a pair of the side walls 16. This internal containing space 12*a* makes a connector engaging part 19 which is adapted to be engaged with the female terminal connector 50 so as to cover an outer surface of a female terminal connector body 52, which will be described below.

Moreover, the five male terminals 11 are provided in parallel on the front wall 13, in such a manner that they are projected from an inner face 13*a* of the front wall 13 into the connector engaging part 19. Specifically, the male terminals 11 are passed through the front wall 13 from an outer face thereof to the inner face opposed to the connector engaging part 19 thereby to be held by the front wall 13.

The male terminal connector body 12 is further provided with projected holding parts 20, fitting recesses 21, and locking through holes 22.

Each of the projected holding parts 20 has a pair of projecting inclined faces 20*a* which are projected from the inner face 13*a* of the front wall 13 in a manner of enclosing an outer periphery 11*a* of a front wall side end part of each of the male terminals 11, and have their both side faces inclined toward projection ends 20*b* so that distances up to the male terminal 11 may be reduced. Specifically, the projected holding part 20 is projected from the inner face of the front wall 13 deep into the connector engaging part 19. The projected holding part 20 is projected along side faces of the male terminal 11 in a direction of its width (that is, a lateral direction of the male terminal). Because the projected holding part 20 extends along the male terminal 11 in this manner, the male terminal 11 is more rigidly held by the front wall 13. Further, the projected holding parts 20 are provided at both sides of the respective male terminals 11 in the direction of width (that is, in the lateral direction of the male terminals), and the projecting inclined faces 20*a* are inclined in such a manner that their heights projected from the inner face of the front wall 13 may become smaller as going away from the male terminals 11.

Moreover, the fitting recesses 21 are parts which are formed in a concave shape on the inner face 13*a* of the front wall 13 at positions between the respective male terminals 11. Specifically, the fitting recesses 21 are holes which are formed between a pair of the projected holding parts 20 positioned between the adjacent two male terminals 11. Fitting projections 61, which will be described below, insert into the fitting recesses 21. On this occasion, the fitting recesses 21 and the fitting projections 61 are adapted to be held with gaps between the fitting recesses 21 and the fitting projections 61. Both upper edges 21*a* of each of the fitting recesses 21 make ends 20*c* of the projecting inclined faces 20*a* at a front wall inner face side.

When the male terminal connector 10 and the female terminal connector 50 are engaged with each other, the locking through holes 22 are locked to locking protuberances 58, which will be described below, thereby to lock the female terminal connector 50 inside the connector engaging part 19.

Then, the female terminal connector 50 will be described.

The female terminal connector 50 is the connector in which the five female terminals 51 are contained. When the female terminal connector 50 is engaged with the male terminal connector 10, the female terminals 51 contained in the female terminal connector 50 are respectively connected to the male terminals 11.

The female terminal connector 50 includes the female terminals 51 and the female terminal connector body 52. The female terminal connector body 52 includes an upper wall 53, a lower wall 54, and a pair of side walls 55, and has a columnar shape having a rectangular shape in cross section.

An internal containing space 52*a* is defined by combination of the upper wall 53, the lower wall 54, and a pair of the side walls 55 of the female terminal connector body 52, and the five female terminals 51 are contained in this internal containing space 52*a*.

More specifically, the five female terminals 51 are respectively contained in female terminal containing rooms 57 which are formed by partitioning the female terminal connector body 52 with the partition walls 56. Front end openings 52*c* which are opened so that the male terminals 11 can be respectively inserted into the female terminal containing rooms 57 are formed in a front end part 52*b* of the female terminal connector body 52. Moreover, rear end openings 52*e* which are opened so that the female terminals 51 can be respectively inserted into the female terminal containing rooms 57 are formed in a rear end face 52*d* of the female terminal connector body 52.

The female terminals 51 are respectively inserted into the female terminal containing rooms 57 from the rear end openings 52*e*, and adapted to be locked at fitting positions inside the female terminal containing rooms 57, for example, by double locking means which is not shown.

It is to be noted that in the connector unit 1 in this Embodiment 1, the both side walls 55 of the female terminal connector body 52 function also as the partition walls 56.

The female terminal connector body 52 is further provided with the locking protuberances 58, partition wall inclined faces 59, and a projecting front end 60.

The locking protuberances 58 are a pair of protruded parts which are protruded in a shape of a lance, from outer faces 55*a* of the respective side walls 55 of the female terminal connector body 52. When the male terminal connector 10 and the female terminal connector 50 are engaged with each other, the locking protuberances 58 are locked to the locking through holes 22 thereby to lock the female terminal connector 50 inside the connector engaging part 19.

The partition wall inclined faces 59 are the faces which are formed on front end side faces 56*a* of the partition walls 56, and inclined substantially in parallel with the projecting inclined faces 20*a*. Specifically, the partition wall inclined faces 59 are the faces which are inclined substantially in parallel with the projecting inclined faces 20*a*, in a state where the male terminal connector 10 and the female terminal connector 50 are engaged with each other.

The projecting front end 60 is a part corresponding to the front end part 52*b* of the female terminal connector body 52, which is directed to the inner face 13*a* of the front wall 13 of the male terminal connector 10, when the male terminal connector 10 and the female terminal connector 50 are engaged with each other. This projecting front end 60 has fitting projections 61 and an enclosing wall part 62. The fitting projections 61 are the portions having a rectangular parallelepiped shape which are projected from the front end parts 56*b* of the partition walls 56 toward the projecting front end 60, and insert into the fitting recesses 21.

The enclosing wall part 62 is the wall which is formed so as to enclose a group of the fitting projections 61 which are projected from the respective partition walls 56.

The connector unit 1 as described above is so constructed that when the male terminal connector 10 and the female terminal connector 50 are engaged with each other, the projecting inclined faces 20*a* and the partition wall inclined faces 59 which are opposed to each other are brought into contact with each other, or made opposed to each other, and the fitting projections 61 insert into the fitting recesses 21, thereby allowing the fitting projections 61 and the fitting recesses 21 to be held leaving gaps between the fitting projections 61 and the fitting recesses 21. Because the creepage distance of the male terminal 11 is the distance along the fitting recess 21 and the projecting inclined faces 20*a*, it is possible to secure the longer creepage distance by a distance along the inner side faces 21*b* of the fitting recess 21. Additionally, because a mating part between the front end part 52*b* of the female terminal connector 50 and the front wall 13 of the male terminal connector 10 becomes complicated in shape, it becomes difficult for foreign matters to insert into connection parts between the male terminals and the female terminals from the exterior. As the results, a short circuit due to the foreign matters can be prevented, and therefore, it is possible to enhance insulating performance, while restraining occurrence of the short circuit due to the foreign matters.

In the connector unit 1 in Embodiment 1 of the invention, because the creepage distance of the male terminal 11 is the distance along the fitting recess 21 and the projecting inclined faces 20*a*, it is possible to secure the longer creepage distance by the distance along the inner side faces 21*b* of the fitting recess 21. Additionally, because the mating part between the front end part 52*b* of the female terminal connector 50 and the front wall 13 of the male terminal connector 10 becomes complicated in shape, it becomes difficult for foreign matters to insert into the connection parts between the male terminals 11 and the female terminals 51 from the exterior. As the results, a short circuit due to the foreign matters can be prevented, and therefore, it is possible to enhance the insulating performance, while restraining occurrence of the short circuit due to the foreign matters.

(Embodiment 2)

Figure 6:
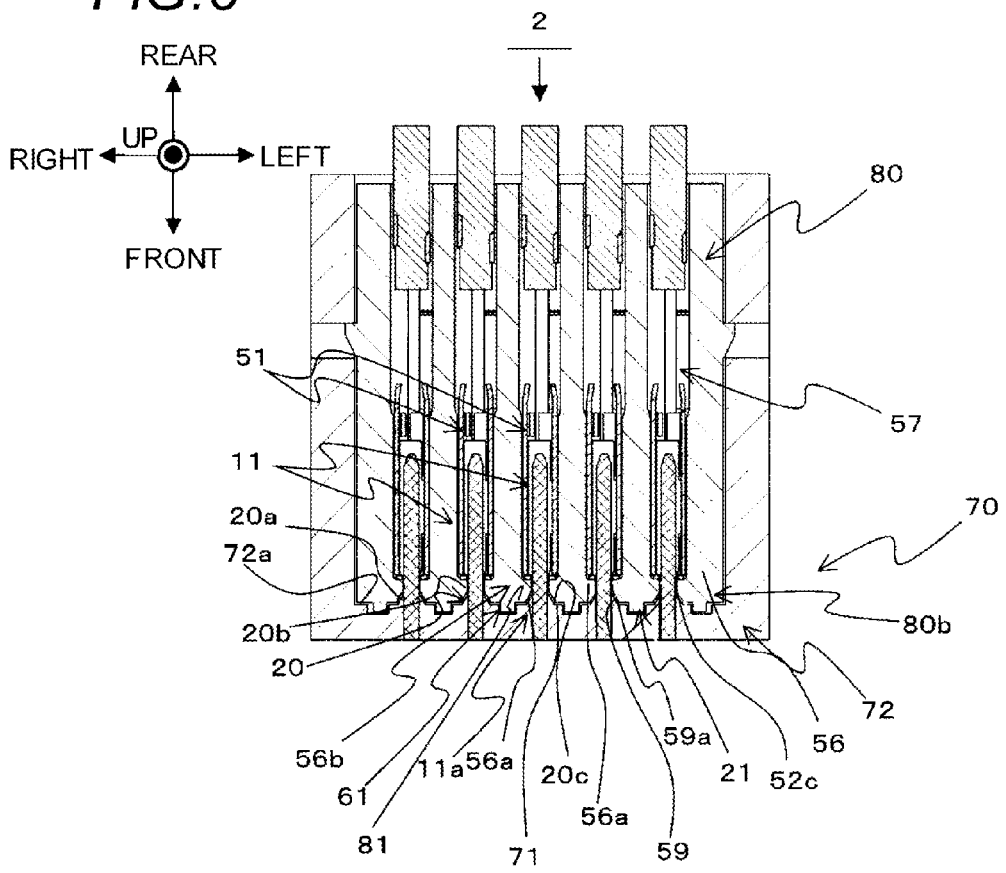
FIG. 6 is a sectional view of a connector unit according to Embodiment 2 of the invention, after engagement.
Figure 7:
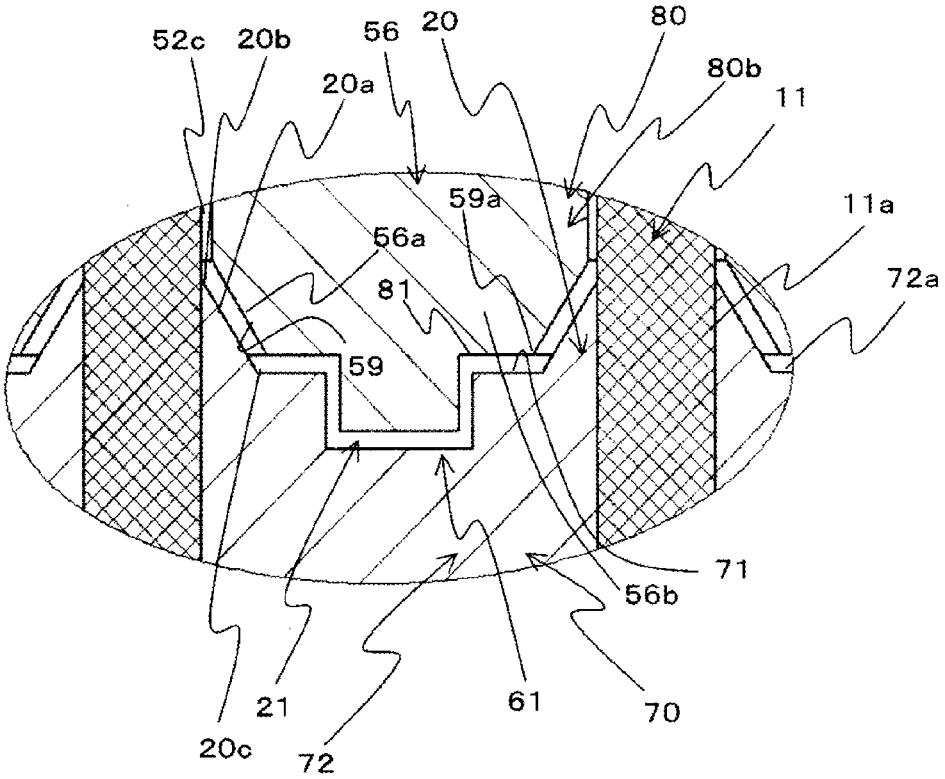
FIG. 7 is an enlarged view of a part of the connector unit as shown in FIG. 6.
Figure 8:
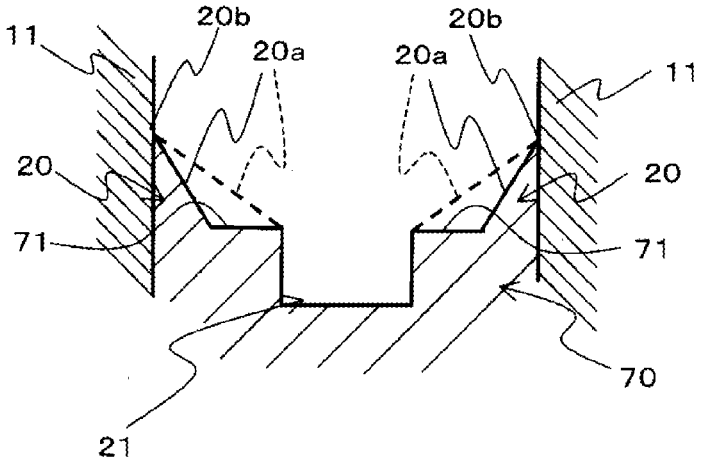
FIG. 8 is a view for comparing creepage distances.
Figure 9:
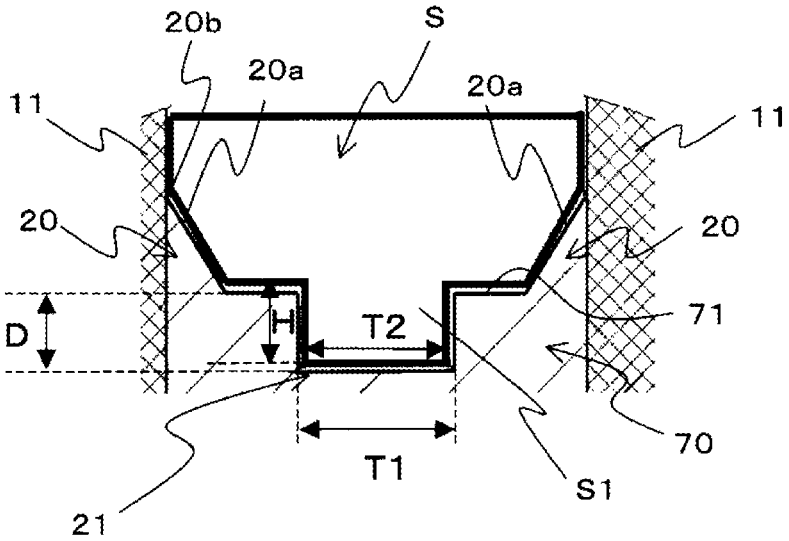
FIG. 9 is a view for explaining enhancement of durability of a mold piece.
Figure 10:
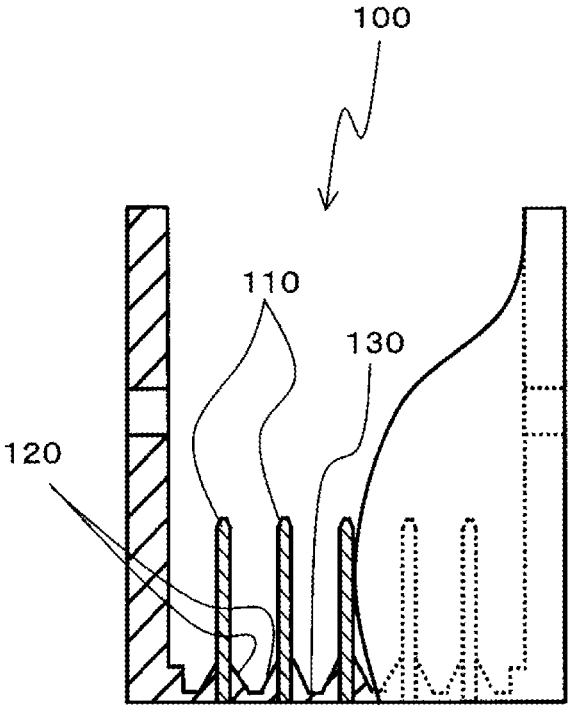
FIG.10 PRIOR ART
FIG. 10 is a view for describing the prior art.

Then, referring to FIGS. 6 to 9, a connector unit 2 according to Embodiment 1 of the invention will be described. FIG. 6 is a sectional view of the connector unit 2 according to Embodiment 2 of the invention, after engagement. FIG. 7 is an enlarged view of a part of the connector unit 2 as shown in FIG. 6. FIG. 8 is a view for comparing the creepage distances. FIG. 9 is a view for explaining enhancement of durability of a mold piece S.

In the connector unit 2 in Embodiment 2 of the invention, a male terminal connector 70 is further provided with male terminal connector side extended faces 71, and a female terminal connector 80 is provided with female terminal connector side extended faces 81.

The other structures in Embodiment 2 are the same as those in Embodiment 1, and therefore, the same components are denoted with the same reference numerals.

The male terminal connector side extended faces 71 are the faces which are further extended from the ends 20*c* of the projecting inclined faces 20*a* at the front wall inner face side, in an arranging direction of a plurality of the male terminals 11.

The female terminal connector side extended faces 81 are the faces which are further extended from the partition wall front end side ends 59*a* of the partition wall inclined faces 59 in an arranging direction of a plurality of the female terminals 51.

When the male terminal connector 70 and the female terminal connector 80 are engaged with each other, the male terminal connector side extended faces 71 and the female terminal connector side extended faces 81 are brought into contact with each other or made opposed to each other.

The connector unit 2 according to Embodiment 2 of the invention is so constructed that the male terminal connector 70 has the male terminal connector side extended faces 71 which are further extended from the ends 20*c* of the projecting inclined faces 20*a* at the front wall inner face side and provided in the arranging direction of a plurality of the male terminals 11 are arranged. Moreover, the female terminal connector 80 has the female terminal connector side extended faces 81 which are further extended from the partition wall front end side ends 59*a* of the partition wall inclined faces 59. When the male terminal connector 70 and the female terminal connector 80 are engaged with each other, the male terminal connector side extended faces 71 and the female terminal connector side extended faces 81 are brought into contact with each other or made opposed to each other. Specifically, as shown in FIG. 8, the part which is formed only by the projecting inclined faces 20*a* in the connector unit 1 in Embodiment 1 is formed by including the projecting inclined faces 20*a* and the male terminal connector side extended faces 71. Accordingly, the creepage distance can be made longer, and consequently, the insulating performance can be further enhanced. Additionally, because a mating part between the front end part 80*b* of the female terminal connector 80 and the front wall 72 of the male terminal connector 70 becomes more complicated in shape, it becomes more difficult for foreign matters to insert into connection parts between the male terminals 11 and the female terminals 51.

In case where the creepage distance of the male terminal 11 in the connector unit 2 is secured in the same manner as in the connector unit 1 in Embodiment 1, it is possible to reduce a depth D of the fitting recess 21 and a width T1 of the bottom face, by utilizing the creepage distance which is increased by the projecting inclined faces 20*a* and the male terminal connector side extended faces 71, as shown in FIG. 9. In this case, it is possible to reduce a height H of a protruded portion S1 of a mold piece S having a rectangular parallelepiped shape to be used for insert molding of the fitting recess 21, and at the same time, to increase a width T2 thereof. As the results, durability of the mold piece S to be used for the insert molding can be enhanced.

It is to be noted that in Embodiments 1 and 2 according to the invention, the connector units 1 and 2 in which a plurality of the male terminals 11 are integrally provided in the male terminal connector body 12 by insert molding have been described, by way of example. However, this is not always the case. Specifically, it would be sufficient that a plurality of the male terminals 11 are arranged in parallel on the front wall 13, 72 of the male terminal connector body 12. For example, a plurality of the male terminals 11 may be press fitted to the front wall 13, 72 of the male terminal connector body 12.

Although in Embodiments 1 and 2 according to the invention, the connector units 1 and 2 in which the fitting projections 61 have the rectangular parallelepiped shape have been described by way of example. However, this is not always the case. Specifically, the fitting projections 61 may have other shapes, provided that they are projected from the front end parts 56*b* of the partition walls 56. For example, the fitting projections 61 may have a cubic shape.

The invention which has been made by the inventors has been specifically described referring to the above described embodiments of the invention. However, the invention is not limited to the above described embodiments. It is also possible to make various modifications within a scope not deviating from the gist of the invention.

Although the invention has been described in detail referring to the specified embodiments, it is apparent to those skilled in the art that various modifications and amendments can be added without deviating from the spirit and scope of the invention.

This invention is based on Japanese Patent Application filed on Jun. 3, 2011 (Application No. 2011-124772), the contents of which are hereby incorporated by reference.

Industrial Applicability

According to this invention, it becomes difficult for foreign matters to insert into the connection parts between the male terminals and the female terminals from the exterior, and consequently, a short circuit due to the foreign matters can be prevented. Therefore, it is possible to attain such advantage that insulating performance can be enhanced while restraining occurrence of the short circuit due to the foreign matters. The invention is usefully applied to the connector unit which has the male terminal connector in which a plurality of the male terminals are provided, and the female terminal connector in which a plurality of the female terminals to be connected to the respective male terminals are contained.

DESCRIPTION OF THE REFERENCE NUMERALS AND SIGNS

1, 2 Connector unit
10, 70 Male terminal connector
11 Male terminal
11*a* Outer periphery of front wall side end part
12 Male terminal connector body
12*a* Internal containing space
13, 72 Front wall
13*a*, 72*a* Inner face
14 Upper wall
15 Lower wall
16 Side wall
17 Rear end part
18 Opening

19 Connector engaging part
20 Projected holding part
20*a* Projecting inclined face
20*b* Projection end
20*c* End at front wall inner face side
21 Fitting recess
21*a* edge
21*b* Inner side face
22 Locking through hole
50, 80 Female terminal connector
51 Female terminal
52 Female terminal connector body
52*a* Internal containing space
52*b*, 80*b* Front end part
52*c* Front end opening
52*d* Rear end face
52*e* Rear end opening
53 Upper wall
54 Lower wall
55 Side wall
55*a* Outer face
56 Partition wall
56*a* Front end side face
56*b* Front end part
57 Female terminal containing room
58 Locking protuberance
59 Partition wall inclined face
59*a* Partition wall front end side end
60 Protruding front end
61 Fitting projection
62 Enclosing wall part
71 Male terminal connector side extended face
81 Female terminal connector side extended face
S Mold piece

The invention claimed is:

1. A connector unit comprising:

a male terminal connector which includes:

a plurality of male terminals; and a male terminal connector body having a front wall where a plurality of the male terminals projected from an inner face thereof are arranged in parallel, and projected holding parts which are projected from the inner face of the front wall along side faces of the respective male terminals; and a female terminal connector which includes:

a plurality of female terminals; and a female terminal connector body having partition walls for forming containing rooms in which a plurality of the female terminals are respectively contained, and a front end part in which openings for enabling the male terminals to be inserted into the containing rooms are formed;

wherein the male terminal connector and the female terminal connector are engaged with each other in a state that the front end part is engaged with the inner face of the front wall;

wherein in the male terminal connector, the projected holding parts have projecting inclined faces which are formed on respective both sides in a lateral direction of the male terminals, and inclined so that their heights projecting from the inner face of the front wall become smaller as being separate away from the male terminals, and fitting recesses are respectively formed between corresponding pairs of the projected holding parts, the pairs of projected holding parts being respectively positioned between adjacent two male terminals;

wherein in the female terminal connector, the partition walls are provided with partition wall inclined faces which are inclined substantially in parallel with the projecting inclined faces when the male terminal connector and the female terminal connector are engaged with each other, and fitting projections which are projected from the front end part and adapted to insert into the fitting recesses; and wherein the projecting inclined faces and the partition wall inclined faces are brought into contact with each other or made opposed to each other, when the male terminal connector and the female terminal connector are engaged with each other, and the fitting projections insert into the fitting recesses so that the fitting projections and the fitting recesses are held with gap between the fitting projections and the fitting recesses.

2. The connector unit according to claim 1, wherein the male terminal connector further includes male terminal connector side extended faces which are respectively formed on the projected holding parts so as to extend from the projecting inclined faces in an arranging direction of the plurality of the male terminals; and wherein the female terminal connector further includes female terminal connector side extended faces which are formed on the partition walls so as to extend from the partition wall inclined faces in an arranging direction of the plurality of the female terminals; and wherein the male terminal connector side extended faces and the female terminal connector side extended faces are brought into contact or made opposed to each other, when the male terminal connector and the female terminal connector are engaged with each other.

3. The connector unit according to claim 2, wherein each of the fitting projections has a rectangular parallelepiped shape.

* * * * *